US010605038B2

(12) United States Patent
Chau et al.

(10) Patent No.: US 10,605,038 B2
(45) Date of Patent: Mar. 31, 2020

(54) LATCH ASSEMBLY USING ON-BOARD MINIATURE HYDRAULICS FOR RCD APPLICATIONS

(71) Applicant: Halliburton Energy Services, Inc., Houston, TX (US)

(72) Inventors: Christopher J. Chau, Plano, TX (US); Christopher Allen Grace, Fort Worth, TX (US); Raymond Ronald Bullock, Hoveton (GB); Jameel Ahmad Khan, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/079,539

(22) PCT Filed: Apr. 1, 2016

(86) PCT No.: PCT/US2016/025649

§ 371 (c)(1),
(2) Date: Aug. 23, 2018

(87) PCT Pub. No.: WO2017/171853

PCT Pub. Date: Oct. 5, 2017

(65) Prior Publication Data

US 2019/0024474 A1 Jan. 24, 2019

(51) Int. Cl.
*E21B 17/01* (2006.01)
*E21B 17/04* (2006.01)
(Continued)

(52) U.S. Cl.
CPC ..... *E21B 33/085* (2013.01); *E21B 17/01* (2013.01); *E21B 17/04* (2013.01); *E21B 17/085* (2013.01)

(58) Field of Classification Search
None
See application file for complete search history.

(56) References Cited

U.S. PATENT DOCUMENTS 7,258,171 B2 8/2007 Bourgoyne et al.
7,926,593 B2 4/2011 Bailey et al.
(Continued)

OTHER PUBLICATIONS

Korean Intellectual Property Office, PCT/US2016/025649, International Search Report and Written Opinion, dated Dec. 23, 2016, 22 pages, Korea.

*Primary Examiner* — Matthew R Buck
*Assistant Examiner* — Douglas S Wood

(57) ABSTRACT

A latch assembly is described for use with a rotating control device. The rotating control device provides a rotating seal to permit pressure control in an annulus surrounding a rotating tubular member such as a drill string in an offshore drilling operation. The latch assembly is operable to engage and disengage a body of the rotating control device from a remote surface location by wireless communication. An on-board actuation system is carried by the latch assembly such that no energy lines (hydraulic or otherwise) are required to couple the latch assembly to the surface location. The latch assembly may include both an operating latch mechanism and a running latch mechanism to selectively couple the latch assembly to one or both of the body of the rotating control device and a tubular member such as a drill string or other conveyance for running and pulling operations.

16 Claims, 5 Drawing Sheets

(51) Int. Cl.

| | |
|---|---|
| ***E21B 44/00*** | (2006.01) |
| ***E21B 33/08*** | (2006.01) |
| ***E21B 47/06*** | (2012.01) |
| ***E21B 47/09*** | (2012.01) |
| ***E21B 33/06*** | (2006.01) |
| *E21B 17/08* | (2006.01) |

(56) References Cited

U.S. PATENT DOCUMENTS

| | | | | |
|---|---|---|---|---|
| 8,322,432 | B2 | 12/2012 | Bailey et al. | |
| 8,408,297 | B2 | 4/2013 | Bailey et al. | |
| 9,359,853 | B2 * | 6/2016 | Nas | E21B 33/085 |
| 9,567,817 | B2 * | 2/2017 | Chambers | E21B 19/24 |
| 2009/0057021 | A1 | 3/2009 | Williams | |
| 2012/0000664 | A1 | 1/2012 | Nas et al. | |
| 2012/0125633 | A1 | 5/2012 | Linde et al. | |
| 2014/0069720 | A1 | 3/2014 | Gray | |
| 2015/0204146 | A1 | 7/2015 | Wagoner et al. | |
| 2017/0247972 | A1 * | 8/2017 | Faugstad | E21B 21/08 |

* cited by examiner

LATCH ASSEMBLY USING ON-BOARD MINIATURE HYDRAULICS FOR RCD APPLICATIONS

CROSS-REFERENCE TO RELATED APPLICATION(S)

This application is a U.S. national stage patent application of International Patent Application No. PCT/US2016/025649, filed on Apr. 1, 2016, the benefit of which is claimed and the disclosure of which is incorporated herein by reference in its entirety.

BACKGROUND

The present disclosure relates generally to equipment useful in operations related to subterranean wellbores, e.g., wellbores employed for oil and gas exploration, drilling and production. More particularly, the disclosure relates to a latch assembly for a rotating control device (RCD) that includes an on-board hydraulic actuation system for remotely operating at least one latch mechanism of the latch assembly.

In operations related to the production of hydrocarbons from subterranean geologic formations, pressure control equipment may be provided for controlling the flow of fluids from downhole to surface locations. For example, blow out preventers and/or an RCD may be provided near a surface location from which a wellbore extends. An RCD may also be referred to as a rotating head, rotating blow-out-preventer, rotating drilling device and/or a rotating diverter, and generally includes a rotating seal member that engages and seals against a rotatable tubular string, e.g., drill pipe, casing, collars, etc. The seal member permits pressure to be controlled in an annulus surrounding the tubular string, thus facilitating operations such as underbalanced chilling or managed pressure drilling wherein the annulus pressure is maintained in a predetermined relationship with a formation pressure. The tubular string may often be arranged for axial sliding through the seal member while the tubular string is rotating or in a non-rotating state such that drilling operations may be carried out while the seal around the tubular member is maintained.

The RCD often includes a latch assembly that permits the rotating seal, a bearing assembly and/or other wellbore tools to be releasably coupled to a body of the RCD (alternatively an RCD body), e.g., an outer tubular member in which the tubular string rotates. It is beneficial to releasably latch the seal member and/or bearing assembly relative to the body of the RCD to permit the seal member, bearing assembly, and/or other devices (e.g., injection devices, valves, plugs, etc.) to be readily installed and removed for maintenance, replacement or other operations when desired. In some terrestrial or onshore applications, the latch assembly may be safely operated by human intervention. However, in offshore applications, it is generally hazardous for a human to be in close proximity to an RCD, e.g., if the RCD is installed in a moon pool area of a floating rig or at a subsea location below a waterline. Therefore, it will be appreciated that improvements are continually needed in the art of constructing remotely operable RCDs. These improvements may be useful whether the RCDs are employed in offshore or terrestrial based rigs.

BRIEF DESCRIPTION OF THE DRAWINGS

The disclosure is described in detail hereinafter, by way of example only, on the basis of examples represented in the accompanying figures, in which.

DETAILED DESCRIPTION

In the following description, even though a figure may depict an apparatus in a portion of a wellbore having a specific orientation, unless indicated otherwise, it should be understood by those skilled in the art that the apparatus according to the present disclosure may be equally well suited for use in wellbore portions having other orientations including vertical, slanted, horizontal, curved, etc. Likewise, unless otherwise noted, even though a figure may depict an offshore operation, it should be understood by those skilled in the art that the apparatus according to the present disclosure is equally well suited for use in onshore or terrestrial operations. Further, unless otherwise noted, even though a figure may depict a wellbore that is partially cased, it should be understood by those skilled in the art that the apparatus according to the present disclosure may be equally well suited for use in fully open-hole wellbores.

The present disclosure includes a latch assembly for an RCD that may be wirelessly operated from a safe location by remote control. A hydraulic actuation system is carried by the latch assembly such that no hydraulic lines coupling the latch assembly to a surface location, e.g., the deck of an offshore rig, are required for operation of the latch assembly. Although the actuation systems described herein are generally described as hydraulic actuation systems, other types actuation systems (electrical, magnetic, thermal, etc.) are contemplated wherein a self-contained energy reservoir is carried by the latch assembly, and wherein stored energy is released from the energy reservoir to operate the latch assembly when remotely signaled. In some instances, the latch assembly includes both an operating latch mechanism and a running latch mechanism. The operating latch mechanism may be operable to couple the latch assembly to a body of the RCD, e.g., a tubular section installed in the riser of an offshore drilling system or a pipe section installed over a wellhead in a terrestrial application. Thus, the operating latch mechanism may fix a longitudinal position of the latch assembly for the duration of a drilling operation, for example. The running latch mechanism may be operable to couple the latch assembly to a drill string or other conveyance for running and pulling operations.

Figure 1:
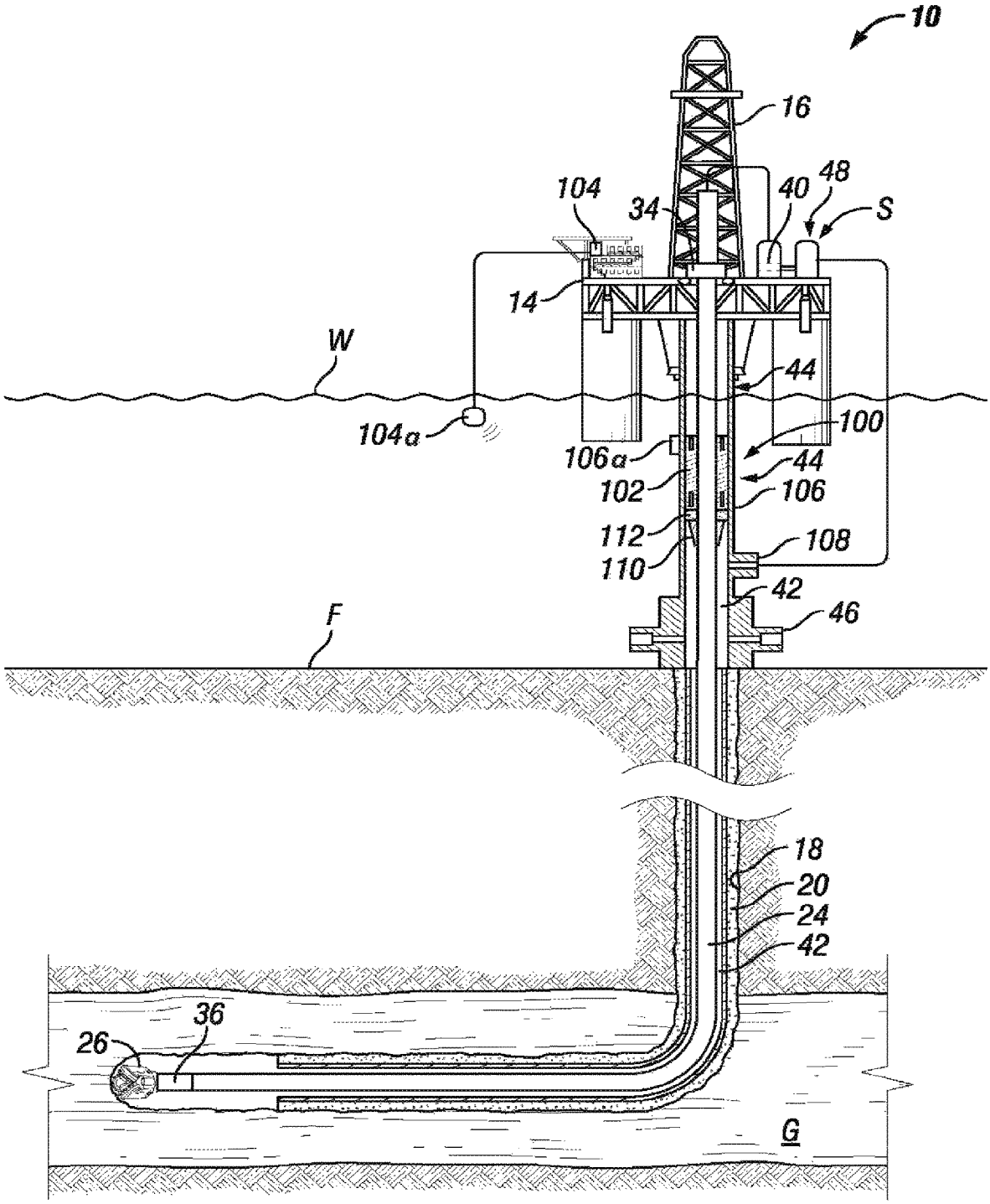
FIG. 1 is a partially cross-sectional side view of a downhole drilling system including an RCD in operation on an offshore platform.

FIG. 1 is a partially cross-sectional side view of an offshore drilling system 10 including an RCD 100. It should be understood that aspects of the disclosure may be practiced in connection with a terrestrial drilling operation, a completion system and/or other wellbore operations. The RCD 100 includes a latch assembly 102 with at least one on-board hydraulic actuation system as described in greater detail below. In the illustrated example, the latch assembly 102 is communicatively coupled to a surface control unit 104 by any of a number of wireless communication technologies. Thus, the latch assembly 102 may be operated from a surface location "S" even when the latch assembly is deployed below a waterline "W."

The surface control unit 104 may be communicatively coupled by a wired or wireless coupling to an acoustic transmitter 104*a* positioned below the waterline "W." The acoustic transmitter 104*a* may be operable to send and/or receive acoustic signals through the surrounding water, and may be responsive to instructions from the surface control unit 104 to transmit acoustic signals to a converter 106*a* disposed on a body 106 of the RCD 100. The acoustic signals may be encrypted by the surface control unit 104 and/or the acoustic transmitter 104*a,* and the converter 106*a* may convert the received acoustical signals to electronic signals for decryption, further processing, and storage. The converter 106*a* may transmit the electronic signals using near-field electromagnetic communication devices to a communication unit 186 (FIG. 4) disposed within the latch assembly 102. In this manner, the latch assembly 102 may be communicatively coupled to the surface control unit 104 with wired, wireless or a combination of communication technologies. The latch assembly 102 may similarly communicate feedback to the surface control unit 104 along a reverse transmission path. For example, the communication unit 186 of the latch assembly may send electromagnetic signals to the converter 106*a,* which may in turn send acoustic signals through the water to the acoustic transmitter 104*a,* and the acoustic transmitter may convert and/or otherwise transmit the received signals to the surface control unit.

The drilling system 10 is illustrated in operation on a semi-submersible offshore platform 14 disposed at the surface location "S." The offshore platform 14 includes a derrick 16, which may facilitate maneuvering wellbore equipment into and out of a wellbore 18. The platform 14 is disposed over a hydrocarbon hearing geologic formation "G," which is located below a sea floor "F," and the wellbore 18 extends through the various earth strata including geologic formation "G." In the illustrated example, a casing string 20 is cemented within the wellbore 18. The casing string 20 extends only partially into the wellbore 18, but it should be understood that the drilling system 10 may be operated in a fully open-hole application. A drill string 24 extends through the casing string 20 and includes a drill bit 26 coupled to a lower end thereof. When rotated, the drill bit 26 operates to break up and generally disintegrate the geological formation "G," and thereby forms the wellbore 18.

The drill bit 26 may be rotated in any of a variety of ways. In this example, the offshore platform 14 supports a turntable 34 thereon, which may be operated to rotate the entire drill string 24 and the drill bit 26 together. The turntable 34 is selectively driven by an engine, chain-drive system, or other apparatus (not shown) disposed on the platform 14 as appreciated by those skilled in the art. A downhole motor 36 may be provided within the drill string 24 to selectively rotate the drill hit 26 with respect to the rest of the drill string 24. The downhole motor 36 may generate torque in response to the circulation of a drilling fluid, such as drilling mud 40, therethrough. As those skilled in the art will recognize, the ability to selectively rotate the drill hit 26 relative to the drill string 24 may be useful in directional drilling, and/or for other operations as well.

The mud 40 can be pumped downhole through an interior of the drill string 24. The mud 40 passes through the downhole motor 36 where energy may be extracted to turn the drill bit 100, or alternatively, the motor 36 may be deactivated and mud 40 may pass relatively freely through the downhole motor 36. After passing through the downhole motor 36, the mud 40 is expelled through nozzles (not shown) defined in the drill bit 26. The mud 40 flushes geologic cuttings and/or other debris from the path of the drill bit 26 as it continues to circulate back up through an annulus 42 defined about the drill string 24. The annulus 42 extends along the drill string 24 though the geologic formation "G," the casing string 20 and a riser 44, which extends generally between a blowout preventer 46 disposed on the sea floor "F" and the offshore platform 14. The geologic cuttings and other debris are carried by the mud 40 to the surface location "S" where the cuttings and debris can be removed from the mud stream.

The RCD 100 is provided within the riser 44, and is operable to seal the annulus 42 while permitting rotation of the drill string 24. In this example, a body 106 of the RCD is integrally constructed in the riser 44 and includes a side port 108, through which the mud 40 may be extracted from the annulus 42. The body 106 may not include a side port, and a flow spool or other diverter (not shown) may be provided in the riser 44 below the RCD 100. The mud 40 may pass from the side port 108 to a circulation system 48 disposed on the offshore platform 14. The circulation system 48 may include chokes or valves to selectively control a pressure of the mud 40 in the annulus 42, e.g., to facilitate underbalanced drilling or managed pressure drilling operations. The circulation system 48 may also include pumps, filters and other fluid control components as recognized by those skilled in the art.

The RCD 100 includes at least one packer element or annular seal member 110 for engaging the drill string 24, To permit the seal member 110 to rotate as the drill string 24 rotates, a bearing assembly 112 is provided between the latch assembly 102 and the seal member 110. The seal member 110 and the bearing assembly 112 may be releasably coupled to the latch assembly 102 for installation into the drilling system 10 as described below. Other wellbore tools may alternatively or additionally be coupled to the latch assembly 100. For example, the latch assembly 102 may have application coupled to a bell nipple, logging or snubbing adapter or other tools and accessories as appreciated by those skilled in the art.

Figure 2:
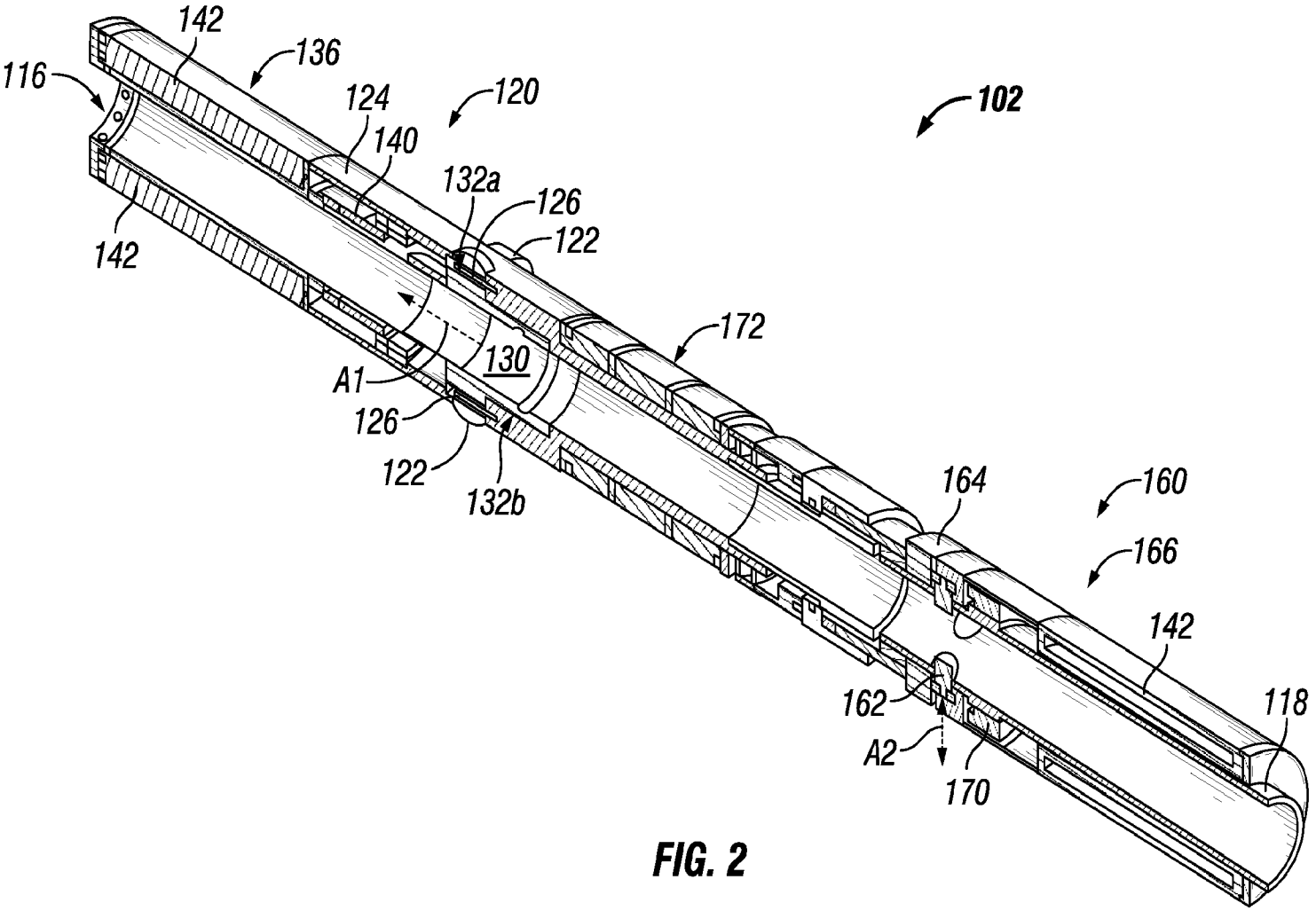
FIG. 2 is a cross-sectional perspective view of a latch assembly of the RCD of FIG. 1 illustrating an operating latch mechanism and a running latch mechanism, which are each operable remotely by a respective one of a pair of on-board actuation systems.

FIG. 2 is a cross-sectional perspective view e latch assembly 102 of the RCD 100 (FIG. 1). The latch assembly 102 defines a longitudinal passageway 116 extending through an interior thereof. The longitudinal passageway 116 is sized for receiving the drill string 24 (FIG. 1) or other a tubular string therein. An exterior of the latch assembly 102 is generally configured such that the latch assembly 102 may be received within an outer tubular member such as the body 106 of the RCD 100 (FIG. 1). A lower or down-hole end of the latch assembly 102 includes a connector 118 for releasably coupling to a wellbore tool such as the bearing assembly 112 and seal member 110 (FIG. 1). The connector 118 may include threads, pinned connectors or other connection mechanisms recognized in the art.

The latch assembly 102 includes an operating latch mechanism 120 for selectively coupling the latch assembly 102 to the body 106 of the RCD 100 (FIG. 1), e.g., to permit operation of the wellbore tool coupled to the latch assembly 102. The operating latch mechanism 120 includes at least one latch member for engaging the body 106 to couple the latch assembly to the body 106. In this example, the at least one latch member includes plurality of latching dogs 122 circumferentially spaced about a housing 124. The latching dogs 122 may be biased radially outwardly with respect to the housing 124 by a biasing member 126 such as a leaf spring, a compression spring, Bellville washer or other biasing device recognized in the art. The shape and spacing of the latching dogs 122 define a distinct latching profile to engage a corresponding latching profile defined in an interior of the RCD body 106 (FIG. 1). The corresponding latching profile may include, e.g., a plurality of recesses sized and positioned to receive each of the latching dogs 122 therein when the latch assembly 102 is properly positioned within body 106.

The latching dogs 122 are carried by the housing 124 and are movable between an engaged position and a disengaged position with respect to the housing 124. For example, the engaged position of the latching dogs 122 may be the radially outward position illustrated in which the latching dogs 122 protrude from the housing 124 and may extend into the recesses of the corresponding latching profile defined in the RCD body 106. The latching dogs 122 may thereby operate to securely fix the latch assembly 102 into the RCD body 106.

The operating latch mechanism 120 further includes a backup sleeve 130 that is operably coupled to the latching dogs 122 to selectively maintain the latching dogs 122 in the engaged position. The backup sleeve 130 is constructed of an annular member longitudinally movable, e.g., in the direction of arrow A1, within the housing 124. The backup sleeve 130 is illustrated in a locking position wherein an outer surface 132*a* of the backup sleeve 130 is longitudinally aligned with the biasing member 126 and/or the latching dogs 122 such that the latching dogs 122 are not permitted to move radially inwardly to the disengaged position. The backup sleeve 130 is longitudinally movable in the direction of arrow A1 to an unlocked. position within the housing 124 to permit radial movement of the latching dogs 122. When the backup sleeve 130 is in the unlocked position, an outer surface 132*b* of the backup sleeve 130 is longitudinally aligned with the latching dogs 132. The outer surface 132*b* defines a smaller outer diameter than the outer surface 132*a*, and thus the latching dogs 122 are permitted to move radially inwardly to the disengaged position against the bias of the biasing member 126.

To move the backup sleeve 130 between the locked and unlocked positions, the latch assembly 102 includes an on-board actuation system 136 carried by the housing 124. The actuation system 136 includes one or more hydraulic actuators such as hydraulic pistons 140 coupled to the backup sleeve 130. Although not shown, the hydraulic actuator may include other components such as a hydraulic motor that turns a lead screw for driving the backup sleeve 130 back and forth between the locked and unlocked positions. The hydraulic pistons 140 are operably coupled to one or more accumulators 142, which supply hydraulic power to activate the hydraulic pistons 140. The accumulators 142 include a reservoir of hydraulic fluid under pressure, e.g., from a spring acting on the hydraulic fluid in the reservoir. As used herein, the term "hydraulic fluid" includes any operating fluid that is operable to impart stored energy to an actuator to thereby induce motion in the actuator. The hydraulic fluid may include an incompressible liquid, and the hydraulic fluid may include a pressurized gas employed in addition to, or in the alternative to, an incompressible liquid. As described in greater detail below, the hydraulic power may be selectively released from the accumulators 142 and delivered to the hydraulic pistons 140 by a control module 150 (FIGS. 3 and 4) carried by the housing 124. The control module 150 may be communicatively and operably coupled to the surface control unit 104 (FIG. 1) or other equipment at the surface location "S" (FIG. 1) in a wireless manner.

In addition to the operating latch mechanism 120, the latch assembly 102 also includes a running latch mechanism 160. The running latch mechanism 160 includes at least one latch member for engaging the drill string 24 (FIG. 1) or other tubular string extending through the longitudinal passageway 116. Coupling the latch assembly 102 to the drill string 24 with the running latch mechanism 160 permits the latch assembly 102 to be run into the riser 44 to reach the RCD body 106, to be pulled out of the riser 44, and/or otherwise maneuvered with the drill string 24 as will be appreciated by those skilled in the art.

Figure 4:
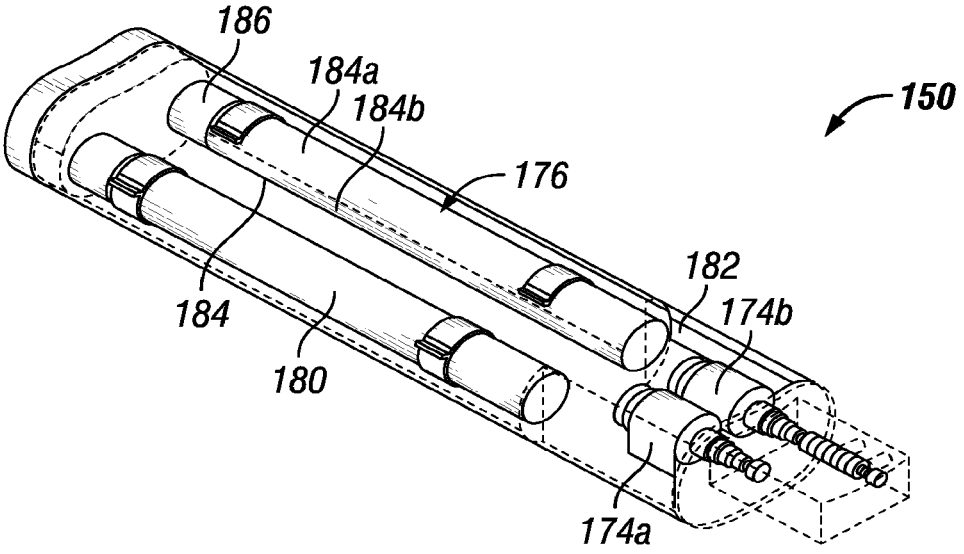
FIG. 4 is a perspective view of a control module of the actuation system illustrating an internal electronics package, an electrical power source and a pair of hydraulic valves.
Figure 5:
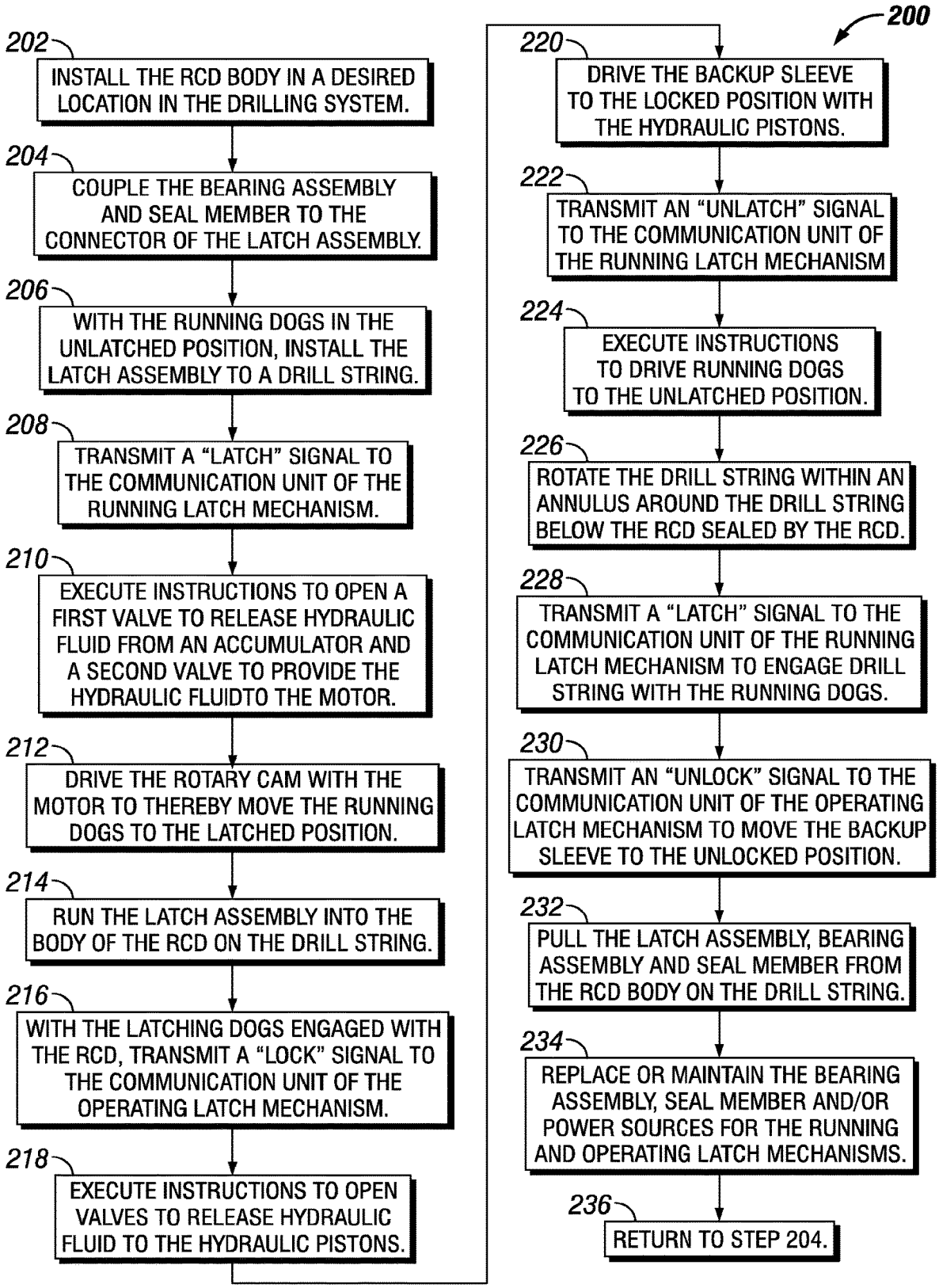
FIG. 5 is a flowchart illustrating an operational procedure for deploying and operating the RCD of FIG. 1 in a drilling operation.

In this example, the at least one latch member of the running latch mechanism 160 includes plurality of running dogs 162 circumferentially spaced about the longitudinal passageway 116. The running dogs 162 are selectively movable in a radial direction, e.g., in the direction of arrows A2 with respect to the housing 124 between a radially inward latching position (as illustrated for engaging the drill string 24) and a radially outward unlatching position (not shown for disengaging the drill string 24). The running dogs 162 are operably coupled to a rotary cam member 164 such that rotation of the rotary cam 164, e.g., rotation about the longitudinal passageway 116, induces radial the movement of the running dogs 162 between the latching position and the unlatching position. To rotate the rotary cam 164, the running latch mechanism 160 includes an on-hoard actuation system 166 carried by the housing 124. The actuation system 166 includes one or more hydraulic actuators such as a hydraulic motor 170 coupled to the rotary cam 164. Similar to the actuation system 136 of the operating latch mechanism 120, the actuation system 166 for the running latch mechanism 166 includes one or more accumulators 142 and a control module 150 (FIGS. 4 and 5). Thus, the running latch mechanism 160 may be remotely operated from the surface location "S" as described in greater detail below.

The latch assembly 102 includes a body seal 172 that may include one or more sealing members such as o-ring seals and/or V-packing stacks for sealing between an exterior of the latch assembly 102 and an interior of the RCD body 106 (FIG. 1). As one skilled in the art will recognize, the sealing members may be carried by the housing 124, fixed within the body 106 and/or provided on both components to effectuate a seal between the latch assembly 102 and the RCD body 106.

Figure 3:
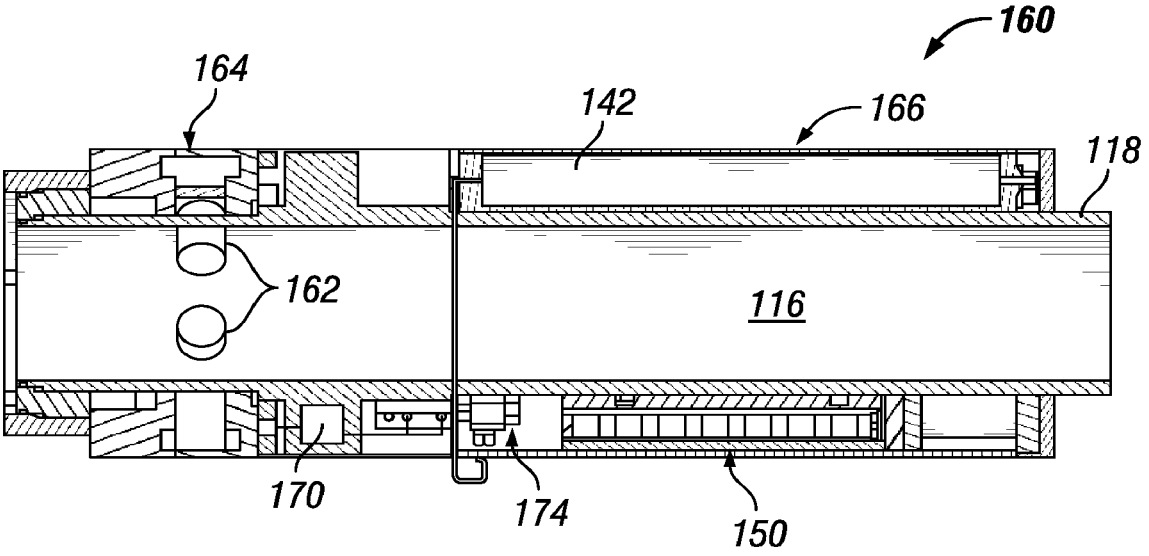
FIG. 3 is a cross-sectional side view of the running latch mechanism and one of the actuation systems of FIG. 2, which are selectively operable for coupling the latch assembly to an inner tubular member, e.g., a drill string for running and pulling operations.

FIG. 3 is a cross-sectional side view of the running latch mechanism 160 and the actuation system 166 for selectively coupling the latch assembly 102 to an inner tubular member, e.g., the drill string 24 (FIG. 1) for running and pulling operations. The actuation system 166 includes control module 150, which is carried by the housing 124. One or more valves 174, such as solenoid valves, are disposed within the control module 150 for selectively controlling the flow of hydraulic fluid between the accumulators 142 and the hydraulic motor 170. The one or more valves 174 may include a first valve 174*a* (FIG. 5) coupled in series to a second valve 174*b*. The first valve 174*a* may be a 2-way, 2-position valve fluidly coupled to the accumulators 142, and may be selectively operable to open and close to thereby respectively permit and restrict flow of hydraulic fluid from/to the accumulators 142, The second valve 174*b* may be a 4-way, 2-position valve fluidly coupled between the first valve 174*a* and the hydraulic motor 170. The second valve 174*b* may be operable for controlling a direction of hydraulic fluid flow through the hydraulic motor 170 for operating the hydraulic motor 170 in two opposite directions. Together the first and second valves 174*a*, 174*b* are operable to activate the hydraulic motor 170 to thereby rotate the rotary cam 164 in opposing directions to drive the running dogs 162 between the latching position and the unlatching position.

The hydraulic motor 170 may be fluidly coupled to the interior passageway 116 or an exterior of the housing 124 such that hydraulic fluid delivered to the hydraulic motor 170 may be expelled from the latch assembly 102 after delivering hydraulic energy to the hydraulic motor 170. An electric hydraulic pump (not shown) may be provided in the control module 150 or elsewhere in the housing 124 to return the hydraulic fluid to the accumulators 142 under pressure such that the hydraulic fluid may be conserved for re-use.

FIG. 4 is a perspective view of the control module 150. The control module 150 generally includes the first and second valves 174*a*, 174*b*, an electronics package 176 and a power source 180. In the illustrated example, each of the valves 174*a*, 174*b*, electronics package 176 and power source 180 are housed together in a control module housing 182. The various internal components of the control module 150 may be supported independently on other portions of the latch assembly 102. The power source 180 is provided to supply energy for the operation of the first and second valves 174*a*, 174*b* and electronics package 176. Power source 180 may comprise a battery contained within the housing 182 or the power source 180 may be a self-contained a turbine operable to generate electricity responsive to the flow of wellbore fluids therethrough.

The electronics package 176 is operatively and communicatively coupled to the first and second valves 174*a*, 174*b* such that the electronics package can selectively instruct the valves 174*a*, 174*b* to open, close and achieve the necessary configurations to appropriately distribute hydraulic fluid from the accumulators 142 to operate the hydraulic actuators including the hydraulic pistons 140 and/or hydraulic motor 170. The electronics package 176 generally includes a controller 184 for providing instructions to the valves 174*a*, 174*b* and a communication unit 186 for receiving instructions and otherwise communicating with the surface control unit 104 (FIG. 1).

The controller 184 may include a computer having a processor 184*a* and a computer readable medium 184*b* operably coupled thereto. The computer readable medium 184*b* can include a nonvolatile or non-transitory memory with data and instructions that are accessible to the processor 184*a* and executable thereby. The computer readable medium 184*b* may be pre-programmed with a predetermined sequence of instructions that will cause the running dogs 162 to move between the latching and unlatching positions, and/or to cause the backup sleeve 130 to move between the locked and unlocked position when prompted by the communication unit 186.

The communication unit 186 may serve as both a transmitter and receiver for communicating signals between the controller 184 and the surface control unit 104 (FIG. 1) or other components of well completion system 10. For example, the communication unit 186 can transmit a status signal, e.g., a signal representative of the position of the backup sleeve 130, or an error signal in the event the controller 184 determines that any component of the latch assembly 102 is not functioning within a predetermined set of parameters. Also, the communication unit 186 can also serve as a receiver for receiving data or instructions from the surface location "S." For example, the communication unit 186 may receive a unique "Latch" signal from an operator at the surface, and transmit the "Latch" signal to the controller 184 to induce the controller 184 to execute a particular predetermined sequence of instructions stored on the computer readable medium 184*b* to provide hydraulic fluid from the accumulators 142 to operate the hydraulic motor 170 until the running dogs 162 engage the drill string 24. The communication unit 186 may comprise a wireless device such as a hydrophone or other types of transducers operable to selectively generate and receive acoustic signals. The communication unit 186 may comprise an RFID reader operable to detect RFID tags carried by mud 40 (FIG. 1) or another drilling fluid. Communication unit 186 can comprise a radio transmitters and receivers, infrared LED transmitters and photoreceptors, microwave, Wi-Fi and/or other wireless telemetry tools as will be appreciated by those skilled in the art. The surface control unit 104 (FIG. 1) may employ any of the similar technologies for communicating with the communication unit 186.

The illustrated control module 150 is arranged to deliver hydraulic power to only one of the running latch mechanism 160 and the operating latch mechanism 120. A control module (not shown) may be configured to deliver hydraulic power to both latch mechanisms 120, 160. For example a single power source 180 and/or a single electronics package 176 may be operatively coupled to a valve bank for delivery of hydraulic power to one or the other of the latch mechanisms 120, 160 depending on the particular signal received, for example.

FIG. 5 is a flowchart illustrating an operational procedure 200 for deploying and operating RCD 100 (FIG. 1) in a drilling operation. With reference to FIG. 5, and with continued reference to FIGS. 1 through 4, initially at step 202 the RCD body 106 is installed. at a desired location in the drilling system 10. As illustrated in FIG. 1, the RCD body 106 may be integrally formed with the riser 44 at a location below the waterline "W" and above the blow-out preventer 46. Below the waterline "W," the RCD body 106 may be generally inaccessible for human intervention. Thus, the remotely operational latch assembly 102 may facilitate use of the RCD body 106 in inaccessible or relatively dangerous locations.

At step 204, a downhole tool, such as the bearing assembly 112 and seal member 110, may be coupled to the connector 118 of the latch assembly 102. The bearing assembly 112 may include threads that correspond to threads of the connector 118, which facilitate coupling the bearing assembly 112 to the latch assembly 102 at the surface location "S." Next at step 206, a drill pipe or other portion of the drill string 24 may be inserted through the longitudinal passageway 116 of the latch assembly 102 and also through the bearing assembly 112 and seal member 110. The running dogs 162 may be maintained in the unlatch position with respect to the housing 124 to permit longitudinal passage of the drill string 24 through the longitudinal passageway 116. The seal member 110 may maintain a sealing relation with the drill string 24 as the drill string 24 moves longitudinally through the longitudinal passageway 116. When the latch assembly 102 is positioned on the drill string 24, a "Latch" signal may be transmitted from the surface control unit 104 to the communication unit 186 of the running latch mechanism (step 208) to thereby longitudinally fix the position of the latch assembly 102 on the drill string 24. Transmitting the "Latch" signal may include using the surface control unit 104 to instruct the acoustic transmitter 104*a* to transmit an acoustic signal to the converter 106*a* positioned on or adjacent the body 106. The converter 106*a* may then convert the acoustic signal to an electromagnetic signal and transmit the electromagnetic signal to the communication unit 186. The signals described below in steps 222, 228 and 230 may be transmitted in a similar manner to the communication unit 186.

The "Latch" signal may cause the processor 184*a* to execute instructions stored on the computer readable medium 184*b* at step 210. The processor 184*a* may cause the first valve 174*a* to open and permit flow of hydraulic fluid from an accumulator 142. The second valve may be instructed to direct the hydraulic fluid to flow through the hydraulic motor 170 in a direction that drives the rotary cam 170 (step 212) in a direction that moves the running dogs 162 to the latching position. The flow of hydraulic fluid may continue until the running dogs 162 engage the drill string 24 and the hydraulic motor 170 stalls. The running dogs 162 may grip the drill string 24 with a force sufficient to prevent longitudinal motion between the latch assembly 102 and the drill string 24. Alternatively or additionally, the running dogs 162 may engage the drill string 24 just above a tool joint that is larger in diameter than adjacent portions of the drill string 24 such that relative longitudinal motion between the drill string 24 and the latch assembly 102 is prevented.

Next at step 212, the latch assembly 102 is run into the riser 44 on the drill string 24 until the latch assembly 102 reaches the RCD body 106. The latching dogs 122 protrude from the housing 124 of the latch assembly 102 and may engage an interior of the riser 44 under the influence of the biasing member 126 as the latch assembly 102 moves down through the riser 44. As the latch assembly 102 is run into the riser 44, the backup sleeve 130 may be maintained in the unlocked position where the outer surface 132*b* is longitudinally aligned with the latching dogs 122. Thus, the latching dogs 122 may be permitted to move radially inwardly to allow the latching dogs 122 to pass over features defined on the interior of the riser 44. When the latching dogs reach the RCD body 106, the biasing member 126 causes the latching dogs 122 to engage the profile defined on the interior of the RCD body 106. A resulting change in resistance to longitudinal movement of the drill string 24 that may be detected from the surface location "S" to verify that the latching dogs 122 are properly engaged with the RCD body 106. When it is verified that the latching dogs 122 are properly engaged, a "Lock" signal may be transmitted from the surface control unit 104 to the communication unit 186 of the operating latch mechanism 120 (step 216). The "Lock" signal may be transmitted by placing one or more appropriate RFID tags (not shown) into the drilling mud 40 at the surface location "S." The RFID tags may be deployed in a gelled pill placed into the mud stream, and may be detected by the communication unit 186 when the RFID tags are carried to a location proximate the RCD 100. RFID tags or other mechanisms may be carried into proximity with the communication unit 186 on a tool joint carried by the drill string 24 or other conveyance. An acoustic signal, radio signal or other type of "Lock" signal may be transmitted to thereby prevent inward radial movement of the latching dogs 122. The longitudinal position of the latch assembly 102 with respect to the RCD body 106 is thereby fixed.

The "Lock" signal may cause the processor 184*a* to execute instructions stored on the computer readable medium 184*b* at step 218. The processor 184*a* may cause the first valve 174*a* to open and permit flow of hydraulic fluid from an accumulator 142 to the hydraulic pistons 140. The hydraulic pistons 140 are thereby induced to drive the back-up sleeve 130 to the locked position in the housing 124 (step 220) where the outer surface 132*a* of the backup sleeve 130 is longitudinally aligned with the latching dogs 122, thus preventing inward radial movement of the latching dogs 122. With latching dogs 122 prevented from inward radial movement, longitudinal movement of the latching dogs 122 from the profile on the RCD body 106 is prevented and the latch assembly 102 is secured in place within the riser 44.

Next at step 222, an "Unlatch" signal is transmitted to the communication unit 186 of the running latch mechanism 160 to release the running dogs 162 from the drill string 42. The "Unlatch" signal may cause the processor 184*a* to execute instructions (step 224) stored on the computer readable medium 184*b* at step 224 to cause the first and second valves 174*a*, 174*b* to direct hydraulic fluid through the hydraulic motor 170 in a direction that induces rotation of the rotary cam 164 in a direction that causes the running dogs 162 to move to unlatched position, e.g., radially outward. As one skilled in the art will appreciate, the hydraulic fluid may be expelled into the wellbore 18 once directed through the hydraulic motor 170, or returned to the accumulator 142 with a hydraulic pump (not shown).

Once the running dogs 162 are released from the drill string 24, the drill string 24 is free to rotate within the RCD 100 while the seal formed therewith by the annular seal member 110 is maintained. At step 226, the drill string 24 may be rotated (and translated) within the RCD 100 as required in a drilling operation. The annulus 42 around the drill string 24 below the RCD 100 is sealed by the sealing member 110 to facilitate underbalanced or managed pressure drilling operations as appreciated by those skilled in the art.

When the drilling operation is complete or discontinued, e.g., for maintenance and/or replacement of the bearing assembly 112, the procedure 200 may proceed to step 228 for removal of the latch assembly 102 from the RCD body 106. A "Latch" signal is transmitted to the communication unit 186 of the running latch mechanism 160 to engage the running dogs 162 with the drill string 24 at step 228. At step 230, an "Unlock" signal is transmitted to the communication unit 186 of the operating latch mechanism 160 to move the backup sleeve 130 to the unlocked position. With the running dogs 162 engaged with the drill string 24 and the latching dogs 122 permitted to move radially inwardly against the bias of the biasing mechanism 126, the latch assembly 102, bearing assembly 112 and seal member 110 may be pulled from the RCD body on the drill string 24 (step 232).

Once the latch mechanism 102 is pulled from the RCD body 106, the latch mechanism 102 may be delivered on the drill string 24 to the surface location "S." At the surface location "S," the bearing assembly 112, seal member 110, power sources 180, and/or other components of the latch assembly 102 may be maintained or replaced (step 234). The procedure 200 may then return to step 204 and the latch assembly 102 may be redeployed into the RCD body 106.

Figure 6:
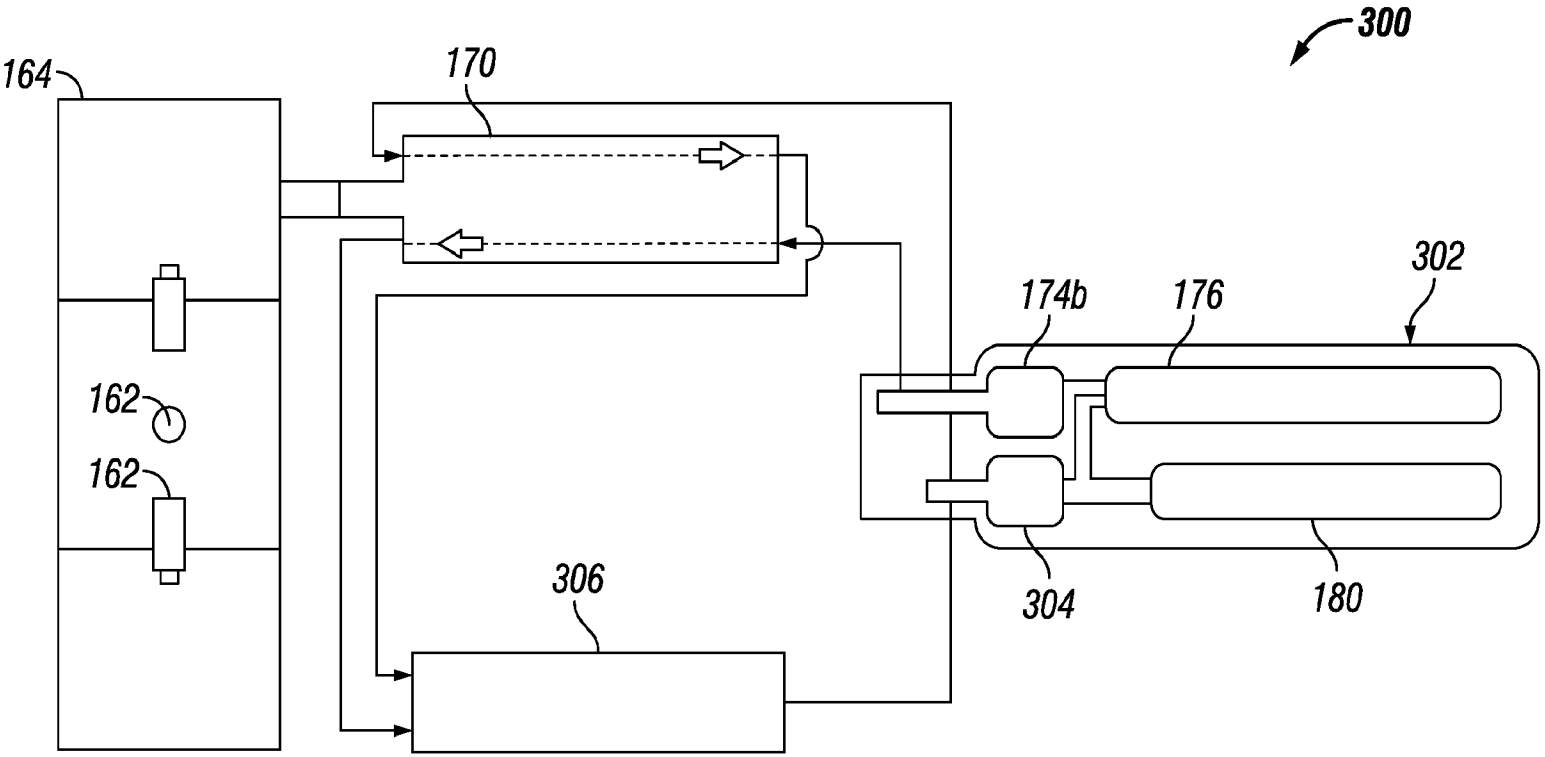
FIG. 6 is a schematic view of a running latch assembly that is operable to recirculate a hydraulic fluid for reuse and illustrating a control module having an electric pump for pressurizing a hydraulic fluid.

FIG. 6 is a schematic view of a running latch mechanism 300 that is operable to recirculate a hydraulic fluid for reuse such that the latch mechanism 300 is not limited to a specific number of operational cycles, e.g., by a finite supply of pressurized hydraulic fluid within an accumulator. As will be appreciated by those skilled in the art, an electric pump 304 may be similarly employed in an operating latch mechanism, as described above, to allow for the reuse of hydraulic fluid. The latch mechanism 300 includes a control module 302 with an electric pump 304 therein that is operable to pressurize a fluid from a hydraulic reservoir 306 carried by the latch mechanism 300, The hydraulic reservoir 306 may be disposed in a location similar to the location of accumulators 142 described above with reference to FIG. 2, but may carry a relatively unpressurized supply of hydraulic fluid.

The control module 302 includes a 4-way, 2-position second valve 174*b,* electronics package 176 and power source 180 similar to the corresponding components of the control module 150 described above. The electric pump 304 is operably coupled to the power source 180 and the electronics package 176 such that the electric pump 304 may be activated upon receiving an appropriate signal from the electronics package 176.

In operation, the electric pump 304 may be activated to draw hydraulic fluids from the reservoir 306 and appropriately pressurize the hydraulic fluids. The electric pump 304 then provides the hydraulic fluid to the 4-way, 2-position valve 174*b,* which may deliver the fluids to a hydraulic actuator such as a hydraulic motor 170 in an appropriate direction as described above. The hydraulic motor 170 rotates the rotary cam 164 in an appropriate direction to move the running dogs 162 between the latching position and the unlatching position as described above. After passing through the hydraulic motor 170, the hydraulic fluid is returned to the reservoir 306. The hydraulic reservoir 306 is operably and fluidly coupled to the hydraulic motor 170 to receive hydraulic fluid from the hydraulic motor 170 for reuse of the hydraulic fluid in subsequent operations. In this manner, the hydraulic fluid may be conserved and reused by reactivating the electric pump 304.

The aspects of the disclosure described below are provided to describe a selection of concepts in a simplified form that are described in greater detail above. This section is not intended to identify key features or essential features of the claimed subject matter, nor is it intended to be used as an aid in determining the scope of the claimed subject matter.

In one aspect the disclosure is directed to a latch assembly for use with a rotating control device. The latch assembly includes a housing selectively connectable to a body of the rotating control device and an operating latch mechanism carried by the housing. The operating latch mechanism is movable between an engaged configuration and a disengaged configuration with respect to the housing for respectively engaging and disengaging the body of the rotating control device. A first actuator is operably coupled to the operating latch mechanism. The first actuator is movable to a locked position to maintain the operating latch mechanism in the engaged configuration and to an unlocked position to release the operating latch mechanism from the engaged configuration to permit movement to of the operating latch mechanism to the disengaged configuration. At least one hydraulic reservoir is carried by the housing, and a first actuation system is carried by the housing that is selectively operable to deliver hydraulic fluid from the at least one hydraulic reservoir to the first actuator to move the first actuator from at least one of the locked and unlocked positions to the other of the locked and unlocked positions.

The hydraulic fluid may include an incompressible liquid, and/or hydraulic fluid may include a pressurized gas such as air.

The actuation system may include a communication unit operable to receive signals from a surface location, and the actuation system may be responsive to the signals to move the first actuator from the at least one of the locked and unlocked positions. The communication unit may include a wireless device operable to selectively receive at least one of an acoustic signal, an optic signal, a radio signal, a microwave signal and a Wi-Fi signal The latch assembly may include a longitudinal passageway to permit passage of a drill string through the latch assembly. The latch assembly may further include a running latch mechanism carried by the housing and selectively movable between an latched configuration and an unlatched configuration with respect to the housing for respectively engaging and disengaging the drill string within the longitudinal passageway, and a second actuator operably coupled to the running latch mechanism, the second actuator operable to move the running latch mechanism from at least one of the latched and unlatched configurations to the other of the latched and unlatched configurations in response to delivery of hydraulic fluid from the at least one hydraulic reservoir to the second actuator. The operating latch mechanism may include at least one latching dog extending radially outwardly from the housing to engage the body of the rotating control device, and the running latch mechanism includes at least one running dog extending radially inwardly from the housing into the longitudinal passageway for engaging the drill string.

The latch assembly may include a biasing member operable to bias the operating latch mechanism to the engaged configuration. The latch assembly may further include a backup sleeve coupled to the first actuator such that the backup sleeve obstructs movement of the latch mechanism from the engaged configuration when the first actuator is in the locked position and permits movement of the latch mechanism from the engaged position against the bias of the biasing member when the first actuator is in the unlocked position.

The actuation system may include at least one valve selectively operable to deliver the hydraulic fluid to the first actuator in a first direction to move the actuator to the locked position and in a second direction to move the first actuator to the unlocked position. The actuation system may further include an electrical power source carried by the housing, and the at least one valve may be a solenoid valve electrically coupled to the power source. The latch assembly may further include a connector at an end thereof for coupling a wellbore tool to the latch assembly. The hydraulic reservoir carried by the housing may be operably coupled to the first actuator to receive hydraulic fluid from the first actuator for reuse of the hydraulic fluid.

In another aspect, the disclosure is directed to a rotating control device for maintaining a seal against a rotating tubular member. The rotating control device includes a body defining a latch profile thereon and a latch assembly including an operating latch mechanism defining a latch profile corresponding to the latch profile defined on the body. The operating latch mechanism is responsive to wireless signals to release hydraulic fluid from at least one hydraulic reservoir carried by the latch assembly to permit or restrict movement of the operating latch mechanism between an engaged configuration and a disengaged configuration with respect to the body. The rotating control device also includes a bearing assembly coupled to the latch mechanism and an annular seal member coupled to the bearing assembly such that the annular seal member is rotatable with respect to the body when the operating latch mechanism is in the engaged configuration with respect to the body.

The latch assembly may include a running latch mechanism responsive to wireless signals to release hydraulic fluid from the at least one hydraulic reservoir to move the running latch mechanism from at least one of a latched configuration and an unlatched configuration to the other of the latched configuration and the unlatched configuration for respectively engaging and disengaging the drill string. The body may define the latch profile on an interior thereof such that the operating latch mechanism engages the body when the latch assembly is longitudinally received within the body and wherein the running latch mechanism is operable to engage the drill string when the drill string is received within a longitudinal passageway defined through the latch assembly.

The latch assembly may further include an electrical power source carried by the latch assembly. The electrical power source may be operably coupled to at least one of the group consisting of a valve for releasing hydraulic fluid from the at least one hydraulic reservoir, a communication unit for receiving the wireless signals and a controller for providing instructions to the at least one valve based on the wireless signals received by the communication unit. The body may further include a converter operable to convert acoustic signals to electromagnetic signals and transmit the electromagnetic signals to the communication unit.

In another aspect, the disclosure is directed to a method of coupling a latch assembly of a rotating control device to a body of the rotating control device. The method includes (a) installing the body in a wellbore system, (b) running the latch assembly into the body on a conveyance to engage an operating latch mechanism with the body (c) transmitting a lock signal to a communication unit of the latch assembly and (d) releasing hydraulic fluid from at least one hydraulic reservoir carried by the latch assembly in response to the lock signal to drive an actuator to a locked position to maintain the latch assembly in an engaged configuration with respect to the body.

The installing of the body may further include coupling the body in at a subsea location in a riser of an offshore wellbore system. The method may further include transmitting a latch signal to the communication unit at a surface location to thereby release hydraulic fluid from the at least one hydraulic reservoir and induce a running latch mechanism to engage the conveyance.

Transmitting of the lock signal to the communication unit may further comprise transmitting an acoustic signal to a converter positioned adjacent the body, converting the acoustic signal to an electromagnetic signal with the converter, and transmitting the electromagnetic signal to the communication unit of the latch assembly. The method may further include coupling a bearing assembly and a seal member to the latch assembly and establishing a rotating sealing relationship between the conveyance and the seal member.

In another aspect, the disclosure is directed to a latch assembly for use with a rotating control device. The latch assembly includes a housing selectively connectable to a body of the rotating control device and operating latch mechanism carried by the housing. The operating latch mechanism is movable between an engaged configuration and a disengaged configuration with respect to the housing for respectively engaging and disengaging the body of the rotating control device. The latch assembly also includes a first actuator operably coupled to the operating latch mechanism. The first actuator is movable to a locked position to maintain the operating latch mechanism in the engaged configuration and to an unlocked position to release the operating latch mechanism from the engaged configuration to permit movement of the operating latch mechanism to the disengaged configuration. The latch assembly also includes at least one energy reservoir carried by the housing and a first actuation system carried by the housing. The first actuation system is selectively operable deliver energy from the at least one energy reservoir to the first actuator to move the first actuator from at least one of the locked and unlocked positions to the other of the locked and unlocked positions. The actuation system includes a communication unit operable to receive signals wireless signals from a surface location, and wherein the actuation system is responsive to the wireless signals to move the first actuator from the at least one of the locked and unlocked positions.

The assemblies, devices and methods of the present disclosure may also be defined with reference to the following statements.

1. A latch assembly for use with a rotating control device, the latch assembly comprising:

a housing selectively connectable to a body of the rotating control device;

an operating latch mechanism carried by the housing, the operating latch mechanism movable between an engaged configuration and a disengaged configuration with respect to the housing for respectively engaging and disengaging the body of the rotating control device;

a first actuator operably coupled to the operating latch mechanism, the first actuator movable to a locked position to maintain the operating latch mechanism in the engaged configuration and to an unlocked position to release the operating latch mechanism from the engaged configuration to permit movement of the operating latch mechanism to the disengaged configuration;

at least one hydraulic reservoir carried by the housing; and a first actuation system carried by the housing and selectively operable to deliver hydraulic fluid from the at least one hydraulic reservoir to the first actuator to move the first actuator from at least one of the locked and unlocked positions to the other of the locked and unlocked positions.

2. The latch assembly of statement 1, wherein the actuation system comprises a communication unit operable to receive signals from a surface location, and wherein the actuation system is responsive to the signals to move the first actuator from the at least one of the locked and unlocked positions.

3. The latch assembly of statement 2, wherein the communication unit is comprises a wireless device operable to selectively receive at least one of an acoustic signal, an optic signal, a radio signal, a microwave signal and a Wi-Fi signal.

4. The latch assembly of any of statements 1 to 3, further comprising a longitudinal passageway to permit passage of a drill string through the latch assembly, 5. The latch assembly of statement 4, further comprising:

a running latch mechanism carried by the housing and selectively movable between an latched configuration and an unlatched configuration with respect to the housing for respectively engaging and disengaging the drill string within the longitudinal passageway; and a second actuator operably coupled to the running latch mechanism, the second actuator operable to move the running latch mechanism from at least one of the latched and unlatched configurations to the other of the latched and unlatched configurations in response to delivery of hydraulic fluid from the at least one hydraulic reservoir to the second actuator.

6. The latch assembly of statement 5, wherein the operating latch mechanism includes at least one latching dog extending radially outwardly from the housing to engage the body of the RCD, and wherein the running latch mechanism includes at least one running dog extending radially inwardly from the housing into the longitudinal passageway for engaging the drill string.
7. The latch assembly of any of statements 1 to 6, further comprising a biasing member operable to bias the operating latch mechanism to the engaged configuration.
8. The latch assembly of statement 7, further comprising a backup sleeve coupled to the first actuator such that the backup sleeve obstructs movement of the latch mechanism from the engaged configuration when the first actuator is in the locked position and permits movement of the latch mechanism from the engaged position against the bias of the biasing member when the first actuator is in the unlocked position.
9. The latch assembly of any of statements 1 to 8, wherein the actuation system comprises at least one valve selectively operable to deliver the hydraulic fluid to the first actuator in a first direction to move the actuator to the locked position and in a second direction to move the first actuator to the unlocked position.
10. The latch assembly of statement 9, wherein the actuation system further comprises an electrical power source carried by the housing, and wherein at least one valve is a solenoid valve electrically coupled to the power source.
11. The latch assembly of any of statements 1 to 10, wherein the hydraulic reservoir carried by the housing is operably coupled to the first actuator to receive hydraulic fluid from the first actuator for reuse.
12. A rotating control device for maintaining a seal against a rotating tubular member, the rotating control device comprising:

a body defining a latch profile thereon;

a latch assembly including an operating latch mechanism defining a latch profile corresponding to the latch profile defined on the body, the operating latch mechanism responsive to wireless signals to release hydraulic fluid from at least one hydraulic reservoir carried by the latch assembly to permit or restrict movement of the operating latch mechanism between an engaged configuration and a disengaged configuration with respect to the body;

a bearing assembly coupled to the latch mechanism; and an annular seal member coupled to the bearing assembly such that the annular seal member is rotatable with respect to the body when the operating latch mechanism is in the engaged configuration with respect to the body.

13. The rotating control device of statement 12, wherein the latch assembly further comprises a running latch mechanism responsive to wireless signals to release hydraulic fluid from the at least one hydraulic reservoir to move the running latch mechanism form at least one of a latched configuration and an unlatched configuration to the other of the latched configuration and unlatched configuration for respectively engaging and disengaging the drill string.
14. The rotating control device of statement 13, wherein the body defines the latch profile on an interior thereof such that the operating latch mechanism engages the body when the latch assembly is longitudinally received within the body and wherein the running latch mechanism is operable to engage the drill string when the drill string is received within a longitudinal passageway defined through the latch assembly.
15. The rotating control device of any of statements 12 to 14, wherein the latch assembly further comprises an electrical power source carried by the latch assembly, the electrical power source operably coupled to at least one of a valve for releasing hydraulic fluid from the at least one hydraulic reservoir, a communication unit for receiving the wireless signals and a controller for providing instructions to the at least one valve based on the wireless signals received by the communication unit.
16. The rotating control device of statement 15, wherein the body further comprises a converter operable to convert acoustic signals to electromagnetic signals and transmit the electromagnetic signals to the communication unit.
17. A method of coupling a latch assembly of a rotating control device to a body of the rotating control device, the method comprising:

installing the body in a wellbore system;

run the latch assembly into the body on a conveyance to engage an operating latch mechanism with the body;

transmit a lock signal to a communication unit of the latch assembly;

release hydraulic fluid from at least one hydraulic reservoir carried by the latch assembly in response to the lock signal to drive an actuator to a locked position to maintain the latch assembly in an engaged configuration with respect to the body.

18. The method of statement 17, wherein installing the body further comprises coupling the body in at a subsea location in a riser of an offshore wellbore system.
19. The method of statement 17 or 18, further comprising transmitting a latch signal to the communication unit at a surface location to thereby release hydraulic fluid from the at least one hydraulic reservoir and induce a running latch mechanism to engage the conveyance.
20. The method of any of statements 17 to 19, wherein transmitting the lock signal to the communication unit further comprises transmitting an acoustic signal to a converter positioned adjacent the body, converting the acoustic signal to an electromagnetic signal with the converter, and transmitting the electromagnetic signal to the communication unit of the latch assembly.
21. The method of any of statements 17 to 20, further comprising coupling a bearing assembly and a seal member to the latch assembly and establishing a rotating sealing relationship between the conveyance and the seal member.
22. A latch assembly for use with a rotating control device, the latch assembly comprising:

a housing selectively connectable to a body of the rotating control device;

an operating latch mechanism carried by the housing, the operating latch mechanism movable between an engaged configuration and a disengaged configuration with respect to the housing for respectively engaging and disengaging the body of the rotating control device;

a first actuator operably coupled to the operating latch mechanism, the first actuator movable to a locked position to maintain the operating latch mechanism in the engaged configuration and to an unlocked position to release the operating latch mechanism from the engaged configuration to permit movement of the operating latch mechanism to the disengaged configuration;

at least one energy reservoir carried by the housing and a first actuation system carried by the housing; and a first actuation system carried by the housing and selectively operable to deliver energy from the at least one energy reservoir to the first actuator to move the first actuator from at least one of the locked and unlocked positions to the other of the locked and unlocked positions.

23. The latch assembly of statement 22, wherein the actuation system comprises a communication unit operable to receive signals from a surface location, and wherein the actuation system is responsive to the signals to move the first actuator from the at least one of the locked and unlocked positions.

The Abstract of the disclosure is solely for providing the United States Patent and Trademark Office and the public at large with a way by which to determine quickly from a cursory reading the nature and gist of technical disclosure, and it represents solely one or more examples.

While various examples have been illustrated in detail, the disclosure is not limited to the examples shown. Modifications and adaptations of the above examples may occur to those skilled in the art, Such modifications and adaptations are in the scope of the disclosure.

What is claimed is:

1. A latch assembly for use with a rotating control device, the latch assembly comprising:

a housing selectively receivable within and connectable to a body of the rotating control device;

an operating latch mechanism carried by the housing, the operating latch mechanism movable between an engaged configuration and a disengaged configuration with respect to the housing for respectively engaging and disengaging the body of the rotating control device;

a first actuator operably coupled to the operating latch mechanism, the first actuator movable to a locked position to maintain the operating latch mechanism in the engaged configuration and to an unlocked position to release the operating latch mechanism from the engaged configuration to permit movement of the operating latch mechanism to the disengaged configuration;

at least one hydraulic reservoir carried by the housing within the body of the rotating control device; and a first actuation system carried by the housing within the body of the rotating control device and selectively operable to deliver hydraulic fluid from the at least one hydraulic reservoir to the first actuator to move the first actuator from at least one of the locked and unlocked positions to the other of the locked and unlocked positions:

wherein the hydraulic reservoir carried by the housing within the body of the rotating control device is operably coupled to the first actuator by both at least one feed line to deliver hydraulic fluid to the first actuator and at least one return line to receive the hydraulic fluid from the first actuator for reuse.

2. The latch assembly of claim 1, wherein the actuation system comprises a communication unit operable to receive signals from a surface location, and wherein the actuation system is responsive to the signals to move the first actuator from the at least one of the locked and unlocked positions.

3. The latch assembly of claim 2, wherein the communication unit is comprises a wireless device operable to selectively receive at least one of an acoustic signal, an optic signal, a radio signal, a microwave signal and a Wi-Fi signal.

4. The latch assembly of claim 1, further comprising a longitudinal passageway to permit passage of a drill string through the latch assembly.

5. The latch assembly of claim 4, further comprising:

a running latch mechanism carried by the housing within the body of the rotating control device and selectively movable between a latched configuration and an unlatched configuration with respect to the housing for respectively engaging and disengaging the drill string within the longitudinal passageway; and a second actuator operably coupled to the running latch mechanism, the second actuator operable to move the running latch mechanism from at least one of the latched and unlatched configurations to the other of the latched and unlatched configurations in response to delivery of hydraulic fluid from the at least one hydraulic reservoir to the second actuator.

6. The latch assembly of claim 5, wherein the operating latch mechanism includes at least one latching dog extending radially outwardly from the housing to engage the body of the RCD, and wherein the running latch mechanism includes at least one running dog extending radially inwardly from the housing into the longitudinal passageway for engaging the drill string.

7. The latch assembly of claim 1, further comprising a biasing member operable to bias the operating latch mechanism to the engaged configuration.

8. The latch assembly of claim 7, further comprising a backup sleeve coupled to the first actuator such that the backup sleeve obstructs movement of the latch mechanism from the engaged configuration when the first actuator is in the locked position and permits movement of the latch mechanism from the engaged position against the bias of the biasing member when the first actuator is in the unlocked position.

9. A latch assembly for use with a rotating control device, the latch assembly comprising:

a housing selectively receivable within and connectable to a body of the rotating control device;

an operating latch mechanism carried by the housing, the operating latch mechanism movable between an engaged configuration and a disengaged configuration with respect to the housing for respectively engaging and disengaging the body of the rotating control device:

a first actuator operably coupled to the operating latch mechanism, the first actuator movable to a locked position to maintain the operating latch mechanism in the engaged configuration and to an unlocked position to release the operating latch mechanism from the engaged configuration to permit movement of the operating latch mechanism to the disengaged configuration;

at least one hydraulic reservoir carried by the housing within the body of the rotating control device; and a first actuation system carried by the housing within the bod of the rotating control device and selectively operable to deliver hydraulic fluid from the at least one hydraulic reservoir to the first actuator to move the first actuator from at least one of the locked and unlocked positions to the other of the locked and unlocked positions:

wherein the actuation system comprises at least one valve selectively operable to deliver the hydraulic fluid to the first actuator in a first direction to move the actuator to the locked position and in a second direction to move the first actuator to the unlocked position; and wherein the actuation system further comprises an electrical power source carried by the housing within the body of the rotating control device, and wherein at least one valve is a solenoid valve electrically coupled to the power source.

10. A rotating control device for maintaining a seal against a rotating tubular member, the rotating control device comprising:

a body defining a latch profile thereon;

a latch assembly receivable within the body and including an operating latch mechanism defining a latch profile corresponding to the latch profile defined on the body, the operating latch mechanism responsive to wireless signals to release hydraulic fluid from at least one hydraulic reservoir carried by the latch assembly within the body of the rotating control device to permit or restrict movement of the operating latch mechanism between an engaged configuration and a disengaged configuration with respect to the body;

a bearing assembly coupled to the latch mechanism; and an annular seal member coupled to the bearing assembly such that the annular seal member is rotatable with respect to the body when the operating latch mechanism is in the engaged configuration with respect to the body; and wherein the latch assembly further comprises an electrical power source carried by the latch assembly within the bod of the rotating control device, the electrical power source operably coupled to at least one of a valve for releasing hydraulic fluid from the at least one hydraulic reservoir, a communication unit for receiving the wireless signals and a controller for providing instructions to the at least one valve based on the wireless signals received by the communication unit.

11. The rotating control device of claim 10, wherein the latch assembly further comprises a running latch mechanism responsive to wireless signals to release hydraulic fluid from the at least one hydraulic reservoir to move the running latch mechanism form at least one of a latched configuration and an unlatched configuration to the other of the latched configuration and unlatched configuration for respectively engaging and disengaging the drill string.

12. The rotating control device of claim 11, wherein the body defines the latch profile on an interior thereof such that the operating latch mechanism engages the body when the latch assembly is longitudinally received within the body and wherein the running latch mechanism is operable to engage the drill string when the drill string is received within a longitudinal passageway defined through the latch assembly.

13. The rotating control device of claim 10, wherein the body further comprises a converter operable to convert acoustic signals to electromagnetic signals and transmit the electromagnetic signals to the communication unit.

14. A method of coupling a latch assembly of a rotating control device to a body of the rotating control device, the method comprising:

installing the body in a wellbore system;

run the latch assembly carrying at least one hydraulic reservoir into the body on a conveyance to engage an operating latch mechanism with the body;

transmit a lock signal to a communication unit of the latch assembly;

release hydraulic fluid from the at least one hydraulic reservoir carried by the latch assembly in response to the lock signal to drive an actuator to a locked position to maintain the latch assembly in an engaged configuration with respect to the body;

transmitting a latch signal to the communication unit at a surface location to thereby release hydraulic fluid from the at least one hydraulic reservoir and induce a running latch mechanism to engage the conveyance; and recirculating the hydraulic fluid to the at least one hydraulic reservoir.

15. The method of claim 14, wherein installing the body further comprises coupling the body in at a subsea location in a riser of an offshore wellbore system.

16. The method of claim 14, wherein transmitting the lock signal to the communication unit further comprises:

transmitting an acoustic signal to a converter positioned adjacent the body;

converting the acoustic signal to an electromagnetic signal with the converter; and transmitting the electromagnetic signal to the communication unit of the latch assembly.

* * * * *